United States Patent [19]

Takaku et al.

[11] Patent Number: 4,779,597

[45] Date of Patent: Oct. 25, 1988

[54] FAIL-SAFE SYSTEM FOR VEHICLE ENGINE

[75] Inventors: Yutaka Takaku; Sigeo Tamaki, both of Katsuta, Japan

[73] Assignee: Hitachi, Ltd., Tokyo, Japan

[21] Appl. No.: 140,227

[22] Filed: Dec. 31, 1987

[30] Foreign Application Priority Data

Jan. 23, 1987 [JP] Japan ..... 62-12528

[51] Int. Cl.[4] ..... F02D 41/22

[52] U.S. Cl. ..... 123/479; 364/431.11

[58] Field of Search ..... 123/479, 399; 364/431.11, 431.12

[56] References Cited

U.S. PATENT DOCUMENTS 4,566,418 1/1986 Yamamoto et al. ..... 123/479
4,641,622 2/1987 Murukami ..... 123/479
4,704,685 11/1987 Martirsons et al. ..... 123/479

FOREIGN PATENT DOCUMENTS 5825853 11/1986 Japan ..... 123/479

*Primary Examiner*—Raymond A. Nelli
*Attorney, Agent, or Firm*—Antonelli, Terry & Wands

[57] ABSTRACT

A fail-safe system against the sticking of the throttle valve is disclosed for an automotive engine at a type with a fuel supply unit and the throttle valve driven through an actuator. The amount of depression of the accelerator pedal is detected by an accelerator pedal sensor. The system further comprises a device for detecting that the throttle valve is stuck, and a device for controlling the fuel flow rate from the fuel supply unit in accordance with an output of the accelerator pedal sensor when the throttle valve is stuck. The system preferably further comprises an auxiliary air path bypassing the throttle valve. The bypass air mount from the auxiliary air path is controlled if the throttle valve is stuck at a low opening degree, while the fuel flow rate of the fuel supply unit is controlled if the throttle valve is stuck at a middle or high opening degree.

6 Claims, 8 Drawing Sheets

* NOTE:

THNGBA = 1 NEED FAIL-SAFE
THNGBA = 0 NO FAIL-SAFE

FAIL-SAFE SYSTEM FOR VEHICLE ENGINE

BACKGROUND OF THE INVENTION

The present invention relates to a fail-safe system for an automotive internal combustion engine in which a throttle valve for controlling the flow rate of intake air of the engine is driven through an electro-mechanical actuator such as a motor, or more in particular to a fail-safe system which effectively functions when the throttle valve of an automotive gasoline engine has stuck.

Automotive engines are now required to satisfy triple major requirements. It must meet the emission gas control regulation and also the requirement of fuel economy, in addition to the dynamic performance. In an automotive engine, whose operating conditions vary over a wide range, fuel flow, ignition timing and etc. are controlled by a computer to satisfy these requirements. Further, an optimum engine control with high accuracy cannot be effected in satisfactory manner any longer by a conventional system in which the motion of an accelerator pedal directly corresponds to the motion of the throttle valve. In view of this, what is called a drive-by-wire system has been suggested, in which the motion of the accelerator pedal is detected by a sensor, the output of which and various parameters representing driving conditions are used by an actuator to drive the throttle valve.

A drive mechanism of the drive-by-wire system comprises a sensor for detecting the amount of depression of the accelerator pedal, a drive circuit for producing a valve drive signal corresponding to the output of the accelerator pedal sensor, and a step motor for opening the throttle valve in accordance with the drive signal. Another system may further includes a gear mechanism for transmitting the rotation of the step motor to the throttle valve.

The throttle valve, which directly controls the engine output, is required to have a very high safety. The drive mechanism of the drive-by-wire system, for its considerably complicated mechanism compared with the conventional system, must be equipped with more safety measures against faults. Especially in the case where the throttle valve sticks while the engine is in operation, the output control of the engine becomes impossible and therefore it is necessary to provide a fail-safe system against a runaway or engine stall.

The Japanese Patent No. JP-B-58-25853 filed for a patent by Toyota Motor Co., Ltd. with Japanese Patent Office on May 23, 1975 and published on May 30, 1983, discloses a fail-safe system comprising mechanical separation means such as an appropriate clutch between the actuator and the throttle valve, whereby the throttle valve is separated from the actuator by the clutch in the event that the throttle valve has stuck and throttle valve is returned to the full-open position by the force of spring.

This prior art system provides satisfactory fail-safe means to the extent that once the throttle valve has stuck, the engine becomes to be idling condition and thus the car is prevented from running away. If the engine is fixed to an idle state, however, the car cannot drive any longer. In the case where the car comes to a standstill on a road in the midst of a desert or out of town, it is difficult to seek a help or drive to a nearby service station on its own.

It is thus desirable that even when the throttle valve has stuck, the engine output can still be controlled so that it may manage to drive to a nearby house or service station for repair.

SUMMARY OF THE INVENTION

The object of the present invention is to provide a fail-safe system for an internal combustion engine which provides a sufficient protection against any case of the throttle valve of the drive mechanism sticking on the one hand and the engine can still be controlled under some restrictions on the other so that the car may continues to be driven safely.

This object is achieved by detecting any case of sticking of the throttle valve and by controlling at least either one of the bypass air flow and the amount of supplied fuel in accordance with the opening degree of the throttle valve under sticked condition.

Assume that the throttle valve sticks with high opening degree. Since the flow rate of intake air is sufficient, the flow rate of fuel from a fuel supply such as an injector is controlled in response to the motion of the accelerator pedal. In the case where the throttle valve sticks with a low opening degree, in contrast, a sufficient air amount is not obtained, and therefore the intake pipe including the throttle valve is equipped with a bypass air path and a bypass valve for controlling the bypass air thereby to control the bypass air flow rate by the bypass valve in response to the motion of the accelerator pedal.

DESCRIPTION OF THE PREFERRED EMBODIMENTS

Figure 1:
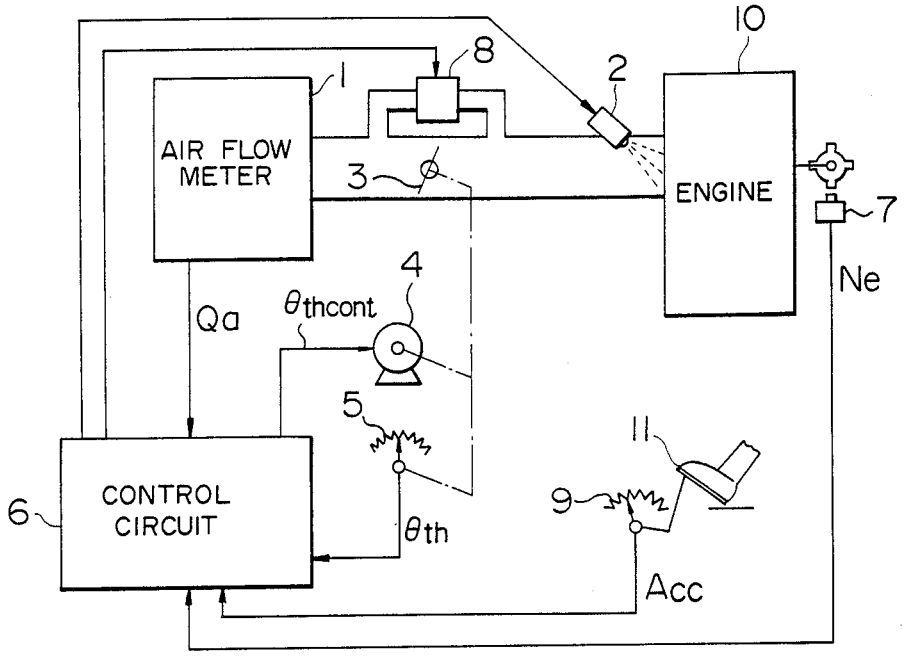
FIG. 1 is a diagram showing an engine control system to which a fail-safe system according to an embodiment of the present invention is applied.

FIG. 1 is a block diagram showing an embodiment of an engine control system of fuel injection type to which a fail-safe system according to the present invention is applied. In FIG. 1, reference numeral 1 designates an intake air flow meter, numeral 2 a fuel injector valve, numeral 3 a throttle valve, numeral 4 an actuator for throttle valve operation, numeral 5 a throttle valve opening degree sensor, numeral 6 a control circuit, numeral 7 an engine speed sensor, numeral 8 a bypass air control valve, numeral 9 an accelerator pedal sensor, numeral 10 an engine, and numeral 11 an accelerator pedal. When the driver steps on the accelerator pedal 11, the amount of depression such as the angle is detected by the accelerator sensor 9, and a signal Acc is applied to the control circuit 6. The control circuit 6 in turn produces a signal $\theta_{thcont}$ for driving the actuator 4 by an amount corresponding to the signal Acc and various parameters indicative of the driving conditions (for example, coolant temperature), with the result that the throttle valve 3 is opened to a degree corresponding to the amount of depression of the accelerator pedal 11.

The control circuit 6 includes a processing control unit such as a microcomputer with a memory unit for controlling the engine 10 by means of a control program stored in the memory unit. When the engine 10 is started and enters a running condition, the intake air flow rate Qa, engine speed Ne and the opening degree $\theta_{th}$ of throttle valve 3 are supplied from the intake air flow meter 1, engine speed sensor 7 and the throttle valve opening degree sensor 5 respectively. These data are processed threreby to determine the injection pulse timing and the injection pulse duration, thus controlling the flow rate from the fuel injector 2. This fuel control process is a well-known control technique and includes various types. The present invention is not limited to any specific one of them. In idle state, in order to prevent fall of the idle engine speed under connection of a load (such as an air conditioner, heater, cooling fan or lighting equipment), the open time of the bypass air control valve 8 is controlled by the control circuit 6 in accordance with an idle control program.

Figure 2:
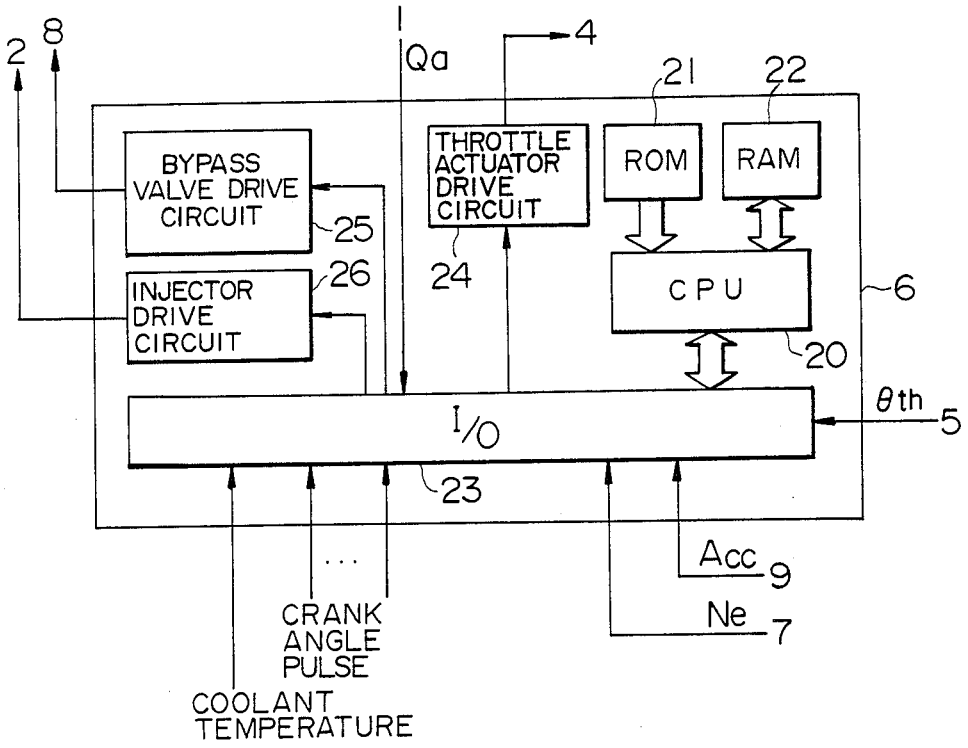
FIG. 2 shows an internal block diagram of the control circuit in FIG. 1.

A specific circuit configuration of the control circuit 6 is shown in FIG. 2. A CPU 20 is a well-known microprocessor for controlling the whole control circuit and has an arithmetic processing function. A program for determining the fuel injection timing and flow rate or a control program for a fail-safe system according to the present invention is stored in a read-only memory 21. Numeral 22 designates a random access memory for temporarily storing data during the arithmetic process. Numeral 23 designates an interface (I/O) for converting signals from external sensors into forms that can be processed by the CPU 20 and also converting signals rrom the CPU 20 into forms adapted for driving external actuators or an injector. The I/O 23 is connected with three drive circuits. A throttle actuator drive circuit 24 amplifies an actuator drive signal from the I/O 23, and applies the output thereof to the throttle valve actuator (motor) 4. The bypass valve drive circuit 25 is for amplifying a bypass air control signal from the I/O 23, and applies an output thereof to the bypass air control valve 8. An injector drive circuit 26 is for converting and amplifying an injector control signal from the I/O 23 and applies an output thereof to the injector 2.

This embodiment is explained with reference to an engine of fuel injection type. The fail-safe system according to the present invention, however, is applicable with equal effect to an engine of carburetor type. In the case of the engine of carburetor type, a solenoid valve for interrupting a fuel path communicated with a main nozzle may be disposed in the fuel path.

Now, explanation will be made about the main routine of engine control in the system under consideration with reference to the flowchart of FIG. 3.

With the start of the engine, the program of the main routine for engine control is started. Step 100 initializes the internal circuits of the control circuit 6. Step 101 applies $\theta_{th}$, Acc, Ne and Qa signals to the CPU 20 through the I/O 5. In addition to these signals, the control circuit 6 may be supplied with a cooling water temperature signal, oxygen sensor output, intake manifold pressure, crank angle signal, vehicle speed signal, etc. and used as parameters for engine control. These other input signals, however, will not be explained any further herein order to clarify the nature of the present invention. Step 102 determines the present intake air flow rate and engine speed. Step 103 executes throttle valve control. In this process of throttle valve control, the throttle valve 3 is driven by the actuator 4 in response to the motion of the throttle pedal 11. This process also includes a fail-safe control in case of the sticking of the throttle valve. Detailed explanation will be made later with reference to FIGS. 4 and 5. The throttle valve control of step 103 is executed at each predetermined time period, say, 10 msec. The fuel injection amount is then controlled at step 104. Step 104 thus determines a required fuel flow rate on the basis of input signals such as the intake air amount and engine speed, and controls the fuel injection period of the injector 2 through the injector drive circuit 26. Step 104 is also executed at each predetermined time period, say, 10 msec. Step 105 controls the amount of bypass air. In the process of bypass air amount, when the load increases while the engine is idling, the bypass air path is opened or closed by the bypass air control valve 8 to regulate the intake air amount, thereby maintaining the idling engine speed at a set value. This step 105 further includes a fail-safe control in case where the throttle valve sticks. Detailed explanation will be made later with reference to FIG. 6. Step 105 is executed at each predetermined time period, say, 20 msec. Step 106 executes ignition timing control. In this process, an optimum ignition timing is determined on the basis of an intake air amount signal, crank angle signal, engine speed signal, water temperature signal, etc., and supplies an ignition system not shown with an ignition timing signal. This step is also executed at each predetermined time period, say, 20 msec. The process of steps 101–106 is repeated.

Figure 3:
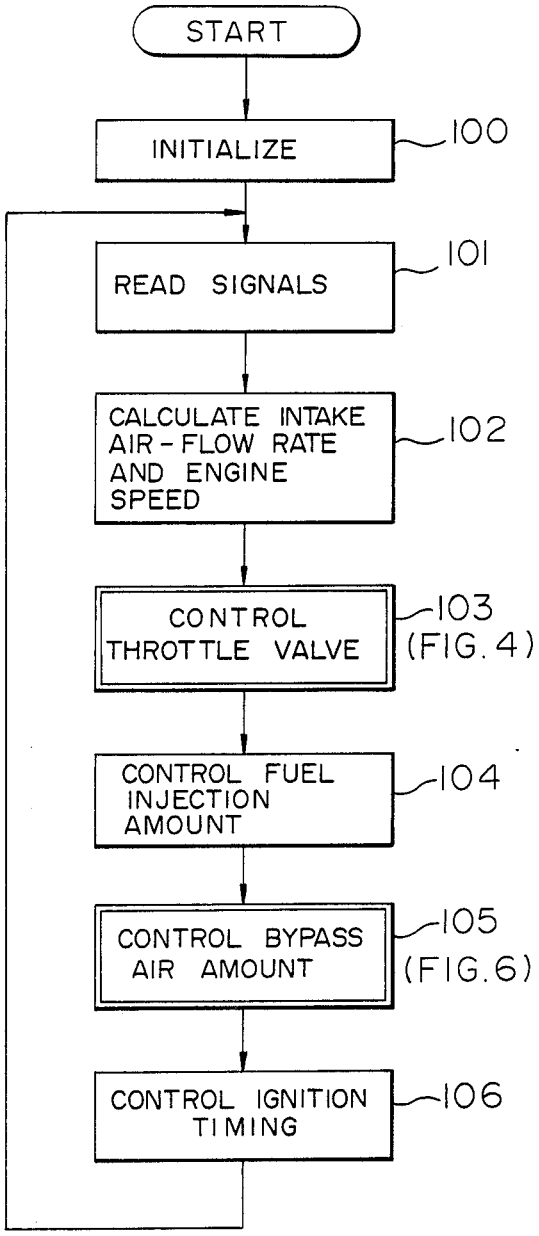
FIG. 3 is a flowchart showing a control main routine for the system shown in FIG. 1.
Figure 4:
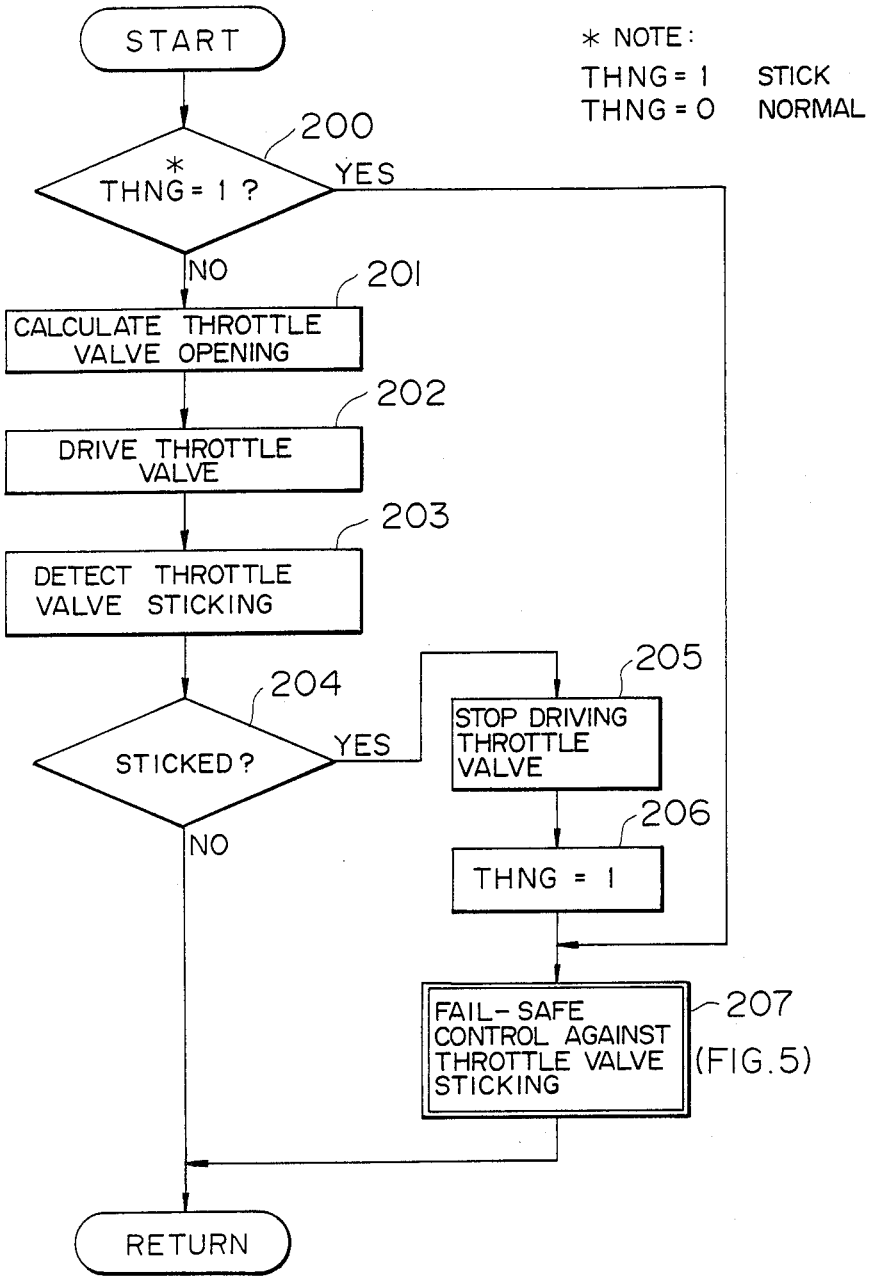
FIG. 4 is a flowchart showing a throttle valve control in the main routine of FIG. 3.
Figure 5:
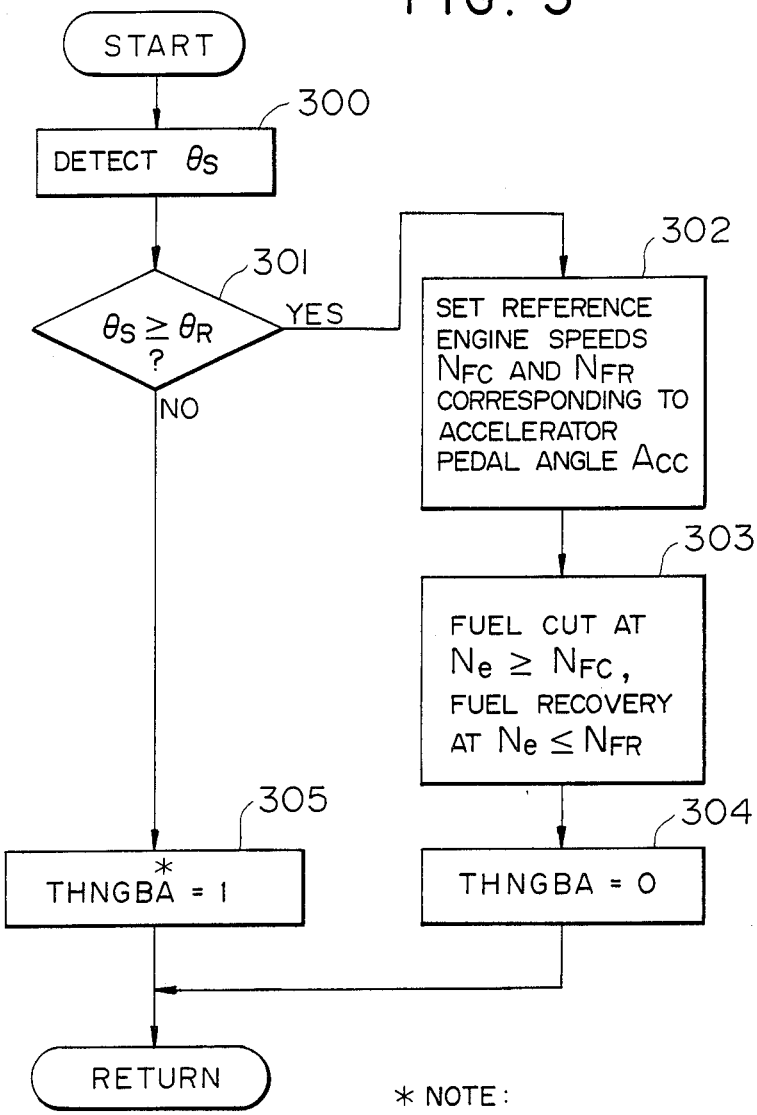
FIG. 5 is a flowchart for fail-safe control in the throttle valve control flow in FIG. 4.
Figure 7:
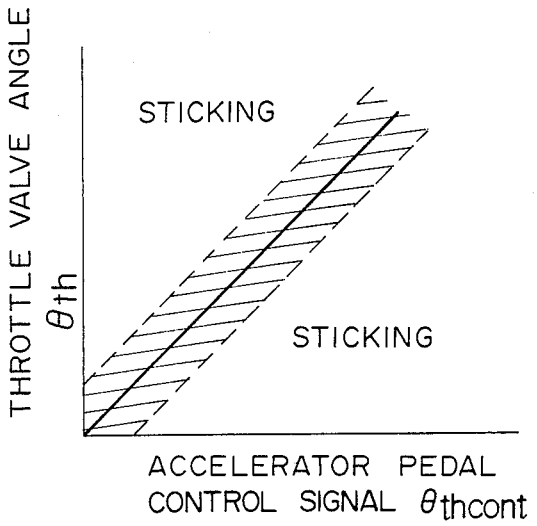
FIG. 7 is a characteristic diagram for explaining the detection of the sticking of the throttle valve.
Figure 8:
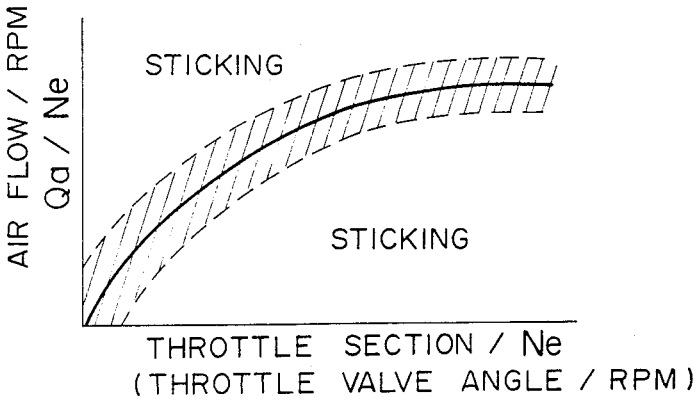
FIG. 8 is a diagram for explaining another case of detecting the sticking of the throttle valve.

FIG. 4 shows a detailed flow of throttle valve control executed at step 103 in FIG. 3. First, step 200 checks a flag THNG of the throttle valve sticking. If the THNG flag is at "1" level, it indicates that the throttle valve sticks, while the "0" level of the THNG flag indicates a normal throttle valve condition. If THNG is "0", step 201 determines a throttle valve opening degree on the basis of the accelerator pedal signal Acc and the other parameter indicative of the driving condition. In accordance with the throttle valve opening degree thus determined, step 202 drives the actuator 4 through the actuator drive circuit 24, thus driving the throttle valve 3. Step 203 detects whether the throttle valve 3 sticks or not. This detection is effected by judging whether the accelerator pedal control signal $\theta_{thcont}$ and the output signal $\theta_{th}$ of the throttle valve opening degree sensor 5 are in a predetermined relationship with each other. The hatched part in the graph of FIG. 7, for example, represent the normal operation, and the other areas the condition of the throttle valve sticked. This judgement is made by whether the difference between the control signal $\theta_{thcont}$ and signal $\theta_{th}$ is included within a predetermined range of values. Another method of detecting a sticked throttle valve state is by using the accelerator pedal control signal $\theta_{thcont}$ and the intake air flow rate signal Qa. The intake air amount per one engine revolution is related to the sectional area of the intake air path per one engine revolution as shown by solid line in FIG. 8. Further, the sectional area of the intake air path has a predetermined relationship with the throttle valve opening degree, and the opening angle of the throttle valve corresponds to $\theta_{thcont}$ under normal conditions. The normal relation between the value of the sectional area determined by $\theta_{thcont}$ and intake air flow Qa is represented by the hatched area of FIG. 8, otherwise sticking of the throttle valve is in the other area. If step 204 decides that the throttle valve sticks, step 205 suspends the driving of the throttle valve 3 by the actuator 4. Step 206 sets "1" at the throttle valve sticking flag THNG. Step 207 executes the fail-safe control explained with reference to FIG. 5 below.

Figure 9:
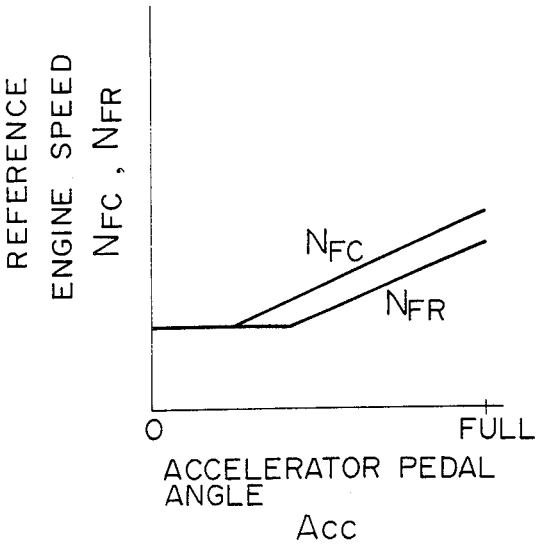
FIG. 9 is a graph showing the relationship between fuel cut, fuel recovery, engine speed and accelerator pedal signal.
Figure 10:
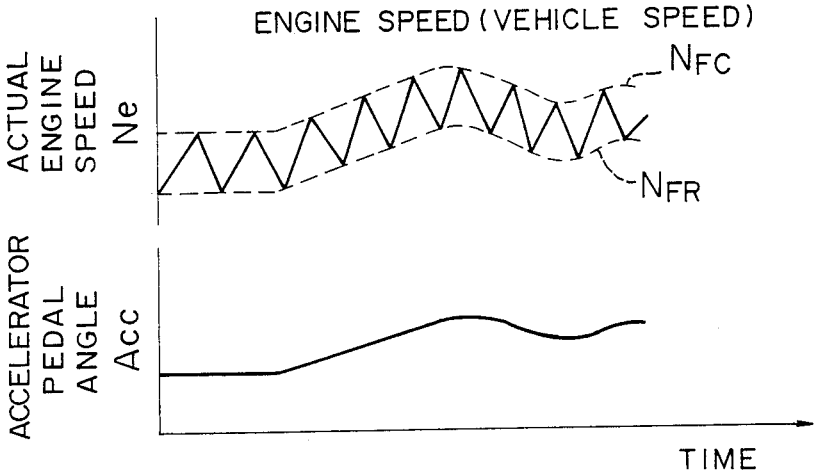
FIG. 10 is a graph for explaining the fail-safe control operation.

When the fail-safe control against throttle valve sticking is started, step 300 causes the throttle sensor 5 to detect the present throttle valve opening degree $\theta_{th}$, that is, the sticked opening degree $\theta_S$. Step 301 compares the sticked opening degree $\theta_S$ with a reference value $\theta_R$. The reference value $\theta_R$ may be selected in optimum design fashion depending on the type of the vehicle involved and the displacement of the engine thereof. The value $\theta_R$ may be selected, for example, at such a low valve opening degree at 5° to 10° that the engine speed is 1,000 to 3,000 rpm under unloaded state. If step 301 decides that $\theta_S > \theta_R$ (middle or wide valve opening degree), step 302 is executed to set the reference engine speed for fuel cut $N_{FC}$ and the reference engine speed for fuel recovery $N_{FR}$ in accordance with the value of the accelerator pedal signal Acc. FIG. 9 shows the relationship held between the reference engine speeds $N_{FC}$ and $N_{FR}$ against the accelerator pedal signal Acc. The difference between these two reference values is arranged to be a predetermined value, say, 100 rpm constant, and provides a hysteresis characteristic. Generally, they are desirably set such that $N_{FC} > N_{FR}$. After the reference values $N_{FC}$, $N_{FR}$ are set, step 303 compares the actual engine speed Ne with the reference values $N_{FC}$, $N_{FR}$. If $Ne \geqq N_{FC}$, it indicates that the engine speed has exceeded an upper limit, so that fuel supply from the injector 2 is stopped by the injector drive circuit 26. If $Ne \leqq N_{FR}$, on the other hand, the engine speed is excessively low as compared with the accelerator pedal signal Acc and therefore fuel is injected from the injector 2 by the injector drive circuit 26. This failsafe control function enables the engine speed Ne to be regulated within the range between the upper reference value $N_{FC}$ and the lower reference value $N_{FR}$ in accordance with the operation of the accelerator pedal 11 as shown in FIG. 10, thus making it possible to control the vehicle with the accelerator pedal without any case of runaway. Now, step 304 set the flag THNGBA to "0". The flag THNGBA is associated with the throttle valve fixing, and is set to "1" when the sticking occurs at a low valve opening degree. In such a case, the fail-safe operation is performed during the period of bypass air amount control explained below. If step 301 decides that $\theta_S < \theta_R$, step 305 sets the flag THNGBA to "1".

Figure 6:
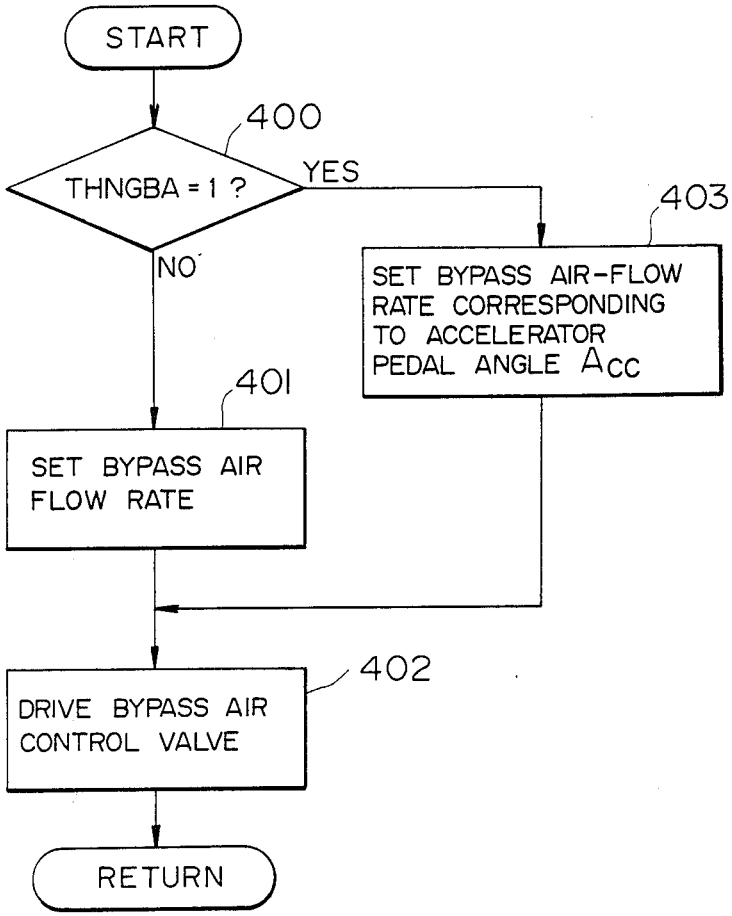
FIG. 6 is a flowchart for control of bypass air flow rate in the main routine of FIG. 3.
Figure 11:
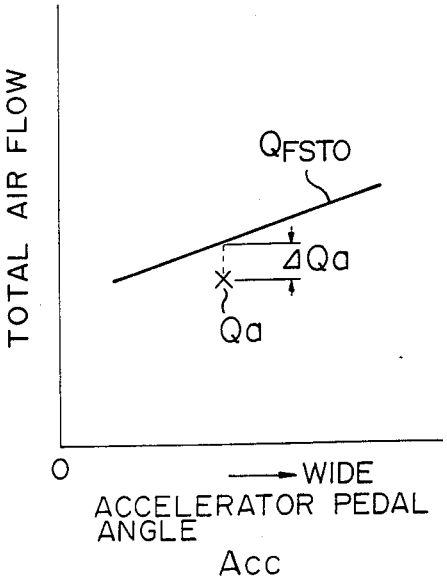
FIG. 11 is a graph for explaining the way of determining the bypass air flow rate.

FIG. 6 shows a detailed flow of the bypass air amount control of step 105 shown in FIG. 3. Step 400 decides whether the flag THNGBA is "1" or not. If the flag THNGBA is not "1", it indicates that the throttle valve is not sticked at a low opening degree, and therefore step 401 sets the bypass air flow rate. This is a normal fast-idle control. The set idling engine speed is thus compared with the actual idling engine speed, and if the actual idling engine speed is lower than the set idling engine speed, the opening amount (duty-ratio) of the bypass air control valve 8 is adjusted to control the bypass air, thereby maintaining the set idling engine speed. Step 401 sets an opening amount of the air control valve 8, and step 402 applies a pulse signal of a duty factor corresponding to the particular opening amount to the bypass valve 8 from the bypass valve drive circuit 25. If step 400 decides that the flag THNGBA is "1", in contrast, it indicates the throttle valve sticked at a low opening degree, and therefore step 403 performs the fail-safe function with the bypass air control valve 8. Step 403 sets a bypass air flow rate corresponding to the accelerator pedal signal Acc thereby to determine the opening amount of the bypass air control valve 8. The bypass air flow rate may be set in the manner mentioned below. As shown by the solid line in FIG. 11, values of all the intake air amounts $\theta_{RSTO}$ corresponding to the accelerator pedal signal Acc are stored in a ROM 21 of the control circuit 6. The actual intake air flow rate Qa is detected by the air flow meter 1 thereby to determine the difference ΔQa between the value in ROM 21 and the actual value. The air amount equivalent to ΔQa determines the opening amount of the bypass air control valve 8. Step 402 causes the bypass valve drive circuit 25 to drive the bypass air control valve 8 by a signal of a duty factor corresponding to the determined valve opening amount. By controlling the bypass air control valve 8 this way, the vehicle is driven safely with the accelerator pedal even if the throttle valve sticks at a low opening degree with a small intake air flow rate.

In the above mentioned embodiment, the sticked throttle valve angle is categorized into small valve angle at which the air bypass control is made and wide valve angle at which the fuel cut (recovery) control is made.

However, in another embodiment, the sticked throttle valve angle may be categorized into three ranges such as small, medium and wide valve angles. At the small angle and the wide angle, the bypass air control and the fuel cut control are made, respectively. At the medium valve angle, both controls are made.

We claim:

1. A fail-safe system for an automotive engine in which a throttle valve for controlling the intake air path of the engine is driven by an actuator, comprising:

means for supplying fuel to the engine;

means for detecting the amount of depression of the accelerator pedal;

means for producing an output signal for controlling said throttle valve on the basis of the detected said amount of depression of the accelerator pedal;

means for detecting that the throttle valve is stuck; and fuel flow rate control means for controlling the fuel flow rate from the fuel supply means in accordance with the amount of depression of the accelerator pedal in response to the detection of the sticking of the throttle valve.

2. A fail-safe system according to claim 1, further comprising means for detecting the opening degree of the throttle valve, said sticking detection means including means for detecting the difference between said output signal of said signal producing means and the detected valve opening degree, said difference detection means producing a signal indicating the sticking of the throttle valve when the difference between the amount of said output signal and the detected valve opening degree exceeds a predetermined value.

3. A fail-safe system according to any one of claims 1 and 2, further comprising engine speed reference value setting means for setting an upper reference value $V_{FC}$ and a lower reference value $V_{FR}$ corresponding to the amount of depression of the accelerator pedal in response to a signal indicating the throttle valve sticking, means for detecting the actual engine speed Ne, and means for comparing the reference values with the detected actual engine speed Ne and producing the result of comparison, said fuel flow rate control means stopping fuel supply from the fuel supply means when the result of comparison shows that the actual engine speed Ne is larger than or equal to the upper value $N_{FC}$ and causes the fuel supply means to inject fuel when the actual engine speed Ne is smaller than or equal to the lower reference value $N_{FR}$.

4. A fail-safe system according to claim 3, wherein said reference values $N_{FC}$ and $N_{FR}$ represent different engine speeds with the difference therebetween fixed and proportional to the amount of depression of the accelerator pedal.

5. A fail-safe system according to claim 4, further comprising an auxiliary air path bypassing the throttle valve, a bypass valve for controlling the auxiliary air path, means for setting the bypass air amount corresponding to the amount of accelerator pedal depression, means for comparing a "stuck" opening degree of the throttle valve with a predetermined throttle valve opening degree reference value $\theta_R$ in response to a signal indicating the fixing of the throttle valve, and means for controlling the bypass air valve in accordance with the set value of the bypass air amount setting means when the "stuck" valve opening degree is lower than the reference value $\theta_R$, said fuel flow rate control means controlling the fuel supply means when the "stuck" valve opening degree is higher than the valve opening reference value $\theta_R$.

6. A fail-safe system according to claim 5, wherein said engine comprises a fuel injection system for determining a required fuel flow rate on the basis of an output of an intake air flow meter and controlling a fuel injector in accordance with the required fuel flow rate, said fuel supply means is the fuel injector, the bypass valve controls the bypass air amount in accordance with a change in duty factor thereof.

* * * * *